United States Patent [19]

Urion

[11] 4,358,025

[45] Nov. 9, 1982

[54] PACKAGE WITH FLEXIBLE SEGMENTED FIN SEALING

[75] Inventor: Kenard E. Urion, Woodbury, N.J.

[73] Assignee: Scott Paper Company, Philadelphia, Pa.

[21] Appl. No.: 243,589

[22] Filed: Mar. 13, 1981

[51] Int. Cl.[3] ..... B65D 51/22

[52] U.S. Cl. ..... 220/258; 215/DIG. 1

[58] Field of Search ..... 220/258, 306, 308; 215/344, DIG. 1

[56] References Cited

U.S. PATENT DOCUMENTS 3,904,074 9/1975 Hoffman et al. ..... 220/258

4,143,785 3/1979 Ferrell ..... 215/344 X

*Primary Examiner*—George T. Hall

*Attorney, Agent, or Firm*—J. H. Yamaoka; J. W. Kane, Jr.

[57] ABSTRACT

An improved packaging system (10) comprising a container (14), a closure (12) for the container (14) and means (38, 60, 34, 66) for retaining the closure over an opening of the container (14). A plurality of fin segments (56, 58) extending between the closure (12) and the container (14) and surrounding a substantial portion of the periphery of the container opening retards the evaporation of moisture from the container (14).

10 Claims, 9 Drawing Figures

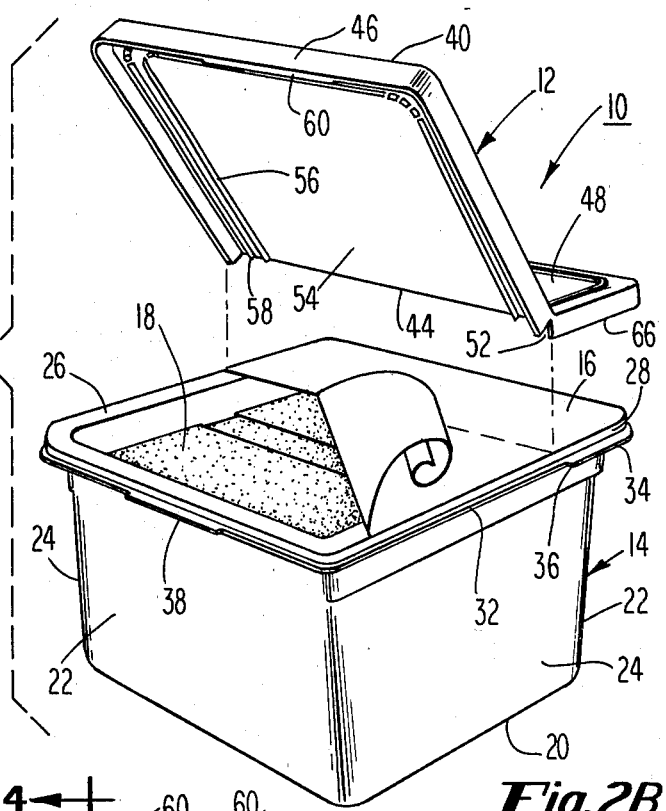
Fig. 1
Fig. 2A
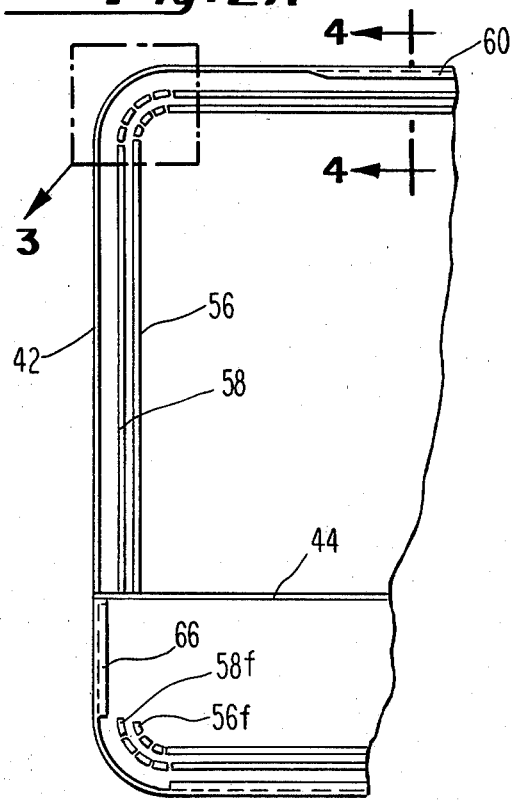
Fig. 2B
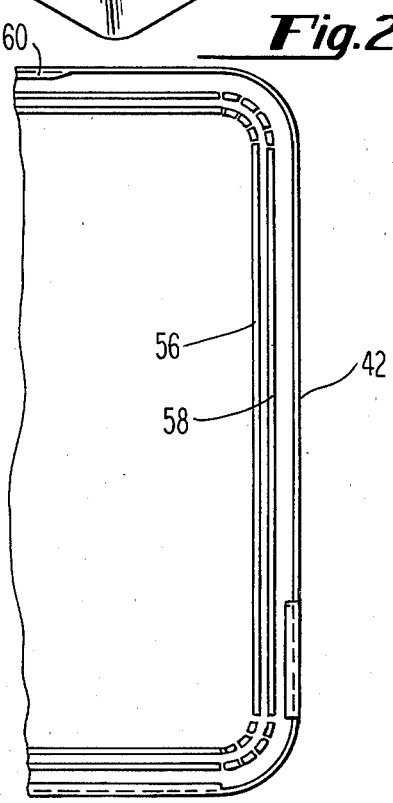

PACKAGE WITH FLEXIBLE SEGMENTED FIN SEALING

TECHNICAL FIELD

This invention relates generally to a packaging system consisting of a container body and a closure therefor, and more particularly to a segmented fin sealing arrangement between the closure and the container body. When the package is used to store premoistened articles, the fin sealing arrangement results in a reduced rate of moisture loss due to evaporation from the package.

BACKGROUND ART

One type of package for premoistened wet wipers is described in U.S. Pat. No. 3,904,074, issued Sept. 9, 1975 to L. S. Hoffman, et al and assigned to the assignee of the present invention. The container is generally rectangular in shape but has rounded corners. The premoistened wet wipers are placed inside the container and a moisture-impervious sheet of foil is adhered to the opening of the container to prevent loss of moisture from the package. After a consumer purchases the wet wiper product, the foil seal is broken to gain access to the wipers and resistance to moisture loss from the package is obtained from the cooperation of the closure and the container. If the rate of moisture evaporation from the package is relatively high compared to the rate of usage of the wiper product, some of the wipers will dry out and will not be of any use to the consumer. In such cases it would be desirable to have secondary sealing means between the closure and the container body which will retard moisture evaporation from the package after the foil seal has been broken.

One possible solution to the above described problem is to employ a continuous sealing fin, inclined from the top wall of the closure, which seals against a lip surrounding the container opening. The use of such continuous fins to provide a seal between a closure and a container having a circular opening are well known in the prior art. Thus, U.S. Pat. Nos. 3,055,526—Plunkett, 3,151,757—Martin, 3,200,981—Harding and 3,255,909—Miller et al, all disclose the use of a threaded cap having a continuous, annular fin seal that is inclined with respect to the top wall of the closure to seal the annular opening of a container. The continuous, inclined, annular fin seal as represented by the patent to Miller et al functions by (1) bending or hinging at the junction of the fin and the top wall of the closure and by (2) circumferential stretching of the fin as it is compressed against a mating annular surface of the container. U.S. Pat. No. 3,215,297—Acton et al discloses a threaded container closure having two concentric, continuous fin seals for sealing the annular opening of a container. U.S. Pat. No. 3,286,866—McIntosh discloses a threaded closure having two concentric, continuous, annular fin seals, the inner fin seal being inclined with respect to the top wall of the closure and providing sealing of an annular opening of a container. U.S. Pat. No. 3,720,342—Vercillo, discloses a safety closure that interlocks with the container, the closures having a continuous annular fin that is inclined with respect to the top wall of the closure and which seals an annular opening of the container.

The packaging system described in the patent to Hoffman et al has been designed so that a relatively small force is required to apply and retain the closure over the container. If the packaging system of Hoffman et al is adapted to include a continuous fin seal as taught by the prior art, it would be necessary to apply a significantly large closing and retaining force to the cover in order to provide and maintain the required circumferential stretching of the continuous fin seal to achieve effective sealing of the package.

DISCLOSURE OF THE INVENTION

In accordance with this invention, there is provided an improved packaging system comprising a container, a closure for the container and means for retaining the closure over an opening of the container. A plurality of fin segments extending between the closure and the container and surrounding a substantial portion of the periphery of the container opening retards the evaporation of moisture from the container. In a preferred embodiment, the fin segments extend downward at an angle from the top wall of the closure and are retained in sealing engagement against a surface of the container. It will, however, be appreciated by those skilled in the art that the fin segments could also extend out at an angle from the container body and be retained in sealing engagement with the top wall of the closure.

If the opening of the container has a rectilinear shape, it is preferred that there be a single linear fin segment for each linear portion of the periphery of the opening, and that any gap between the ends of adjacent fin segments be kept to a minimum. If the peripheral opening of the container includes curvilinear sections which subtend large central angles, plural fin segments are used to traverse the curvilinear section, each segment being either straight, or if curved, subtends a relatively small central angle so that very small circumferential stretching forces are set up in each fin segment as it is brought into sealing engagement between the closure and the container body.

In one embodiment of the invention, the container walls form a flat ledge that surrounds the opening of the container. When the closure is retained over the container opening, fin segments extending down from the top wall of the closure contact the flat ledge to provide a very good seal all along the length of the fin segment. The fin segments are designed to be very flexible and to easily hinge or bend at the junction of the fin and the top wall of the closure so that relatively small circumferential stresses are set up in each fin segment with the result that a relatively small force is required to apply and maintain the fin segments in good sealing engagement with the ledge surrounding the container opening. In another embodiment of the invention, two spaced-apart concentric rows of segmented fins seal against the flat ledge. When two rows of fin segments are employed, it is preferred that the gap between adjacent segments of one row of fins is opposed to a fin segment in the other row to provide a labyrinthian seal.

In another embodiment of the invention, the container walls form a flat ledge that surrounds the container opening and a single row of segmented fins seals against either the external or internal edge of the ledge.

Since there are small gaps between the fin segments, the fin seal of this invention is not moisture-impervious. Although it may be possible to utilize the segmented fin seals of this invention as a primary sealing means, it is contemplated that segmented fin seals will find their greatest use as a secondary sealing means. Thus, when the segmented fin seal is combined with the moisture-impervious foil seal described in the Hoffman et al patent, the fin segments act to retard the rate of evaporation of moisture from the container after the primary seal has been broken by the consumer.

BRIEF DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

FIG. 1 is an isometric view of a package that employs the segmented sealing fins of the invention;

FIG. 2A is a partial bottom view of the closure depicted in FIG. 1;

FIG. 2B is a partial bottom view of a closure illustrating a preferred configuration for each set of sealing fins;

BEST MODE FOR CARRYING OUT THE INVENTION

Figure 3:
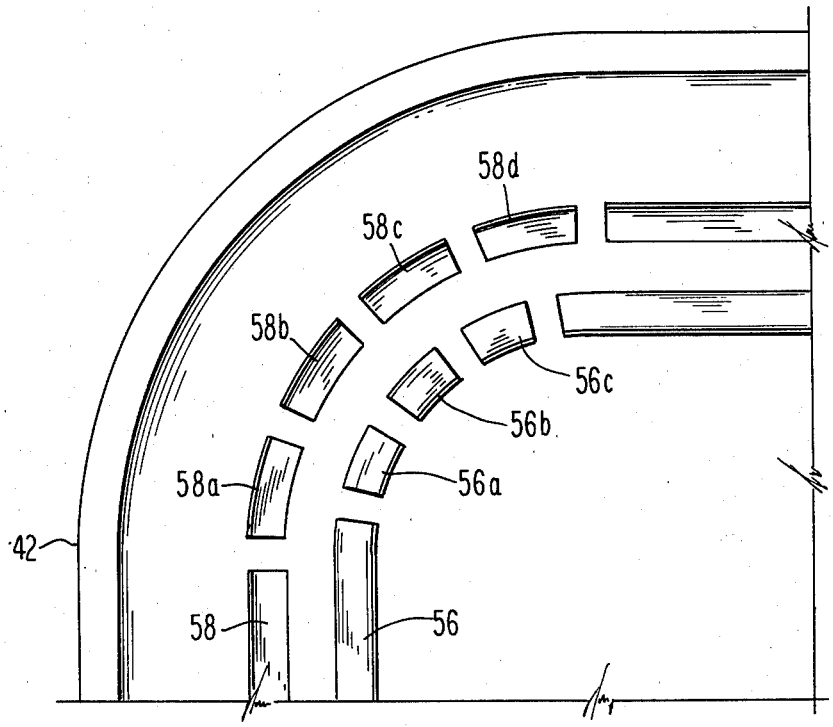
FIG. 3 is an enlarged view of the blocked portion of FIG. 2A.

For the sake of convenience, an element depicted in more than one figure will retain the same element number in each figure. Referring to FIG. 1, the improved packaging system of this invention includes a container body 14 and a closure 12. The improved packaging system can be used, for example, as a container for pre-moistened fibrous webs which can be employed as wipers for many applications. The container body 14 and the closure 12 are preferably made of a plastic material such as polyethylene or polypropylene, however, other suitable materials can be used. Although the packaging system shown has a rectangular shape, other polygonal as well as circular or oval shapes can also be used.

The container body 14 includes a bottom wall 20, front and rear end walls 22 and side walls 24. The upper portion of the end and side walls each include a flat narrow ledge 26 which defines a container opening. A product, such as pre-moistened wet wipers 18, is placed in the container 14 and a moisture-impervious sheet 16 is then secured to the ledge 26 surrounding the opening of the container 14 to provide a primary seal for the package 10. The sheet 16 maintains a moisture-impervious condition within the container body 14 to thereby establish a long shelf life of up to several years for the product. The moisture-impervious sheet 16 can be made from aluminum foil, plastic materials, laminates of paper, or any other suitable material.

The container body 14 includes a peripheral skirt 28 which extends down from the outer edge of the ledge 26. Typically, the peripheral skirt 28 terminates in a downwardly facing peripheral shoulder 32. A portion of the peripheral shoulder 32, centered along the length of front wall 22, is extended to provide a front shoulder projection 38. In a similar manner, a portion of peripheral shoulder 32 adjacent to rear wall 22 and running along the entire length of rear wall 22 is extended to provide a rear shoulder projection 34. The transition between peripheral shoulder 32 and rear shoulder projection 34 forms a forwardly facing shoulder 36 on each side of the container body 14.

Referring now to FIGS. 1 and 2, the closure 12 includes a top wall 40 and a downwardly extending peripheral skirt 42 extending around the outer periphery of the top wall 40. Two opposing sides of peripheral skirt 42 are notched at 52 and a narrow portion of the top wall extending from the notch 52 on one side of the closure 12 to the notch 52 on the other side of the closure 12 is thinned to form a hinge 44 that divides the closure into a rear closure portion 48, which is adapted to remain stationary with respect to the container body 14 when the closure 12 is snapped onto the container body, and a front door portion 46, which is movable about the hinge 44 to permit access to the pre-moistened wet wipers 18 within the container body 14 and to permit subsequent reclosure of the packaging system 10.

Referring to FIGS. 1 and 2, the rear, stationary portion 48 of the closure 12 includes structure for cooperating with the container body 14 to retain the rear portion 48 in a stationary condition when the closure 14 is attached to the container body 14. Specifically, the rear, stationary portion 48 includes inwardly directed side projections 66 which are positioned in closely underlying relationship with the rear extended shoulders 34 of the container body 14 when the rear portion 48 of the closure 12 is snapped over the container body 14. When the closure 12 is assembled over the container body 14, the cooperation of inwardly directly projection 66 with rear extended projections 34 prevents the closure 12 from being inadvertently lifted off of the container body 14 when the front door portion 46 of the closure 12 is opened and closed. The rear portion 48 of the closure 12 further includes inturned tabs 68 which cooperate with the forwardly facing shoulders 36 of the container body 14 to prevent the closure from sliding off the rear of the container body 14 when the front door portion 46 is in an open position. The front door portion 46 of the closure 12 includes an inwardly directed projection 60 which cooperates with the front extended shoulder 38 of the container body 14 to provide cooperable latch means which retains the front door portion 46 in a closed position.

Further details of the design of the closure 12 and the container body 14 are set forth in the aforementioned patent issued to L. S. Hoffman et al.

As shown in FIG. 1, two spaced apart sets or rows 56, 58 of segmented fin seals extend down from the under surface 54 of the top wall 40 of closure 12. When the closure 12 is placed over the container body 14, the two rows 56, 58 of fin segments cooperate with ledge 26 surrounding the opening of the container body 14 to provide a secondary seal against moisture evaporation after the moisture-impervious seal 16 has been broken to gain access to the pre-moistened wet wipers 18 inside of the container body 14. The ledge 26 surrounding the opening of the container body 14 is essentially rectangular with rounded corners. As shown in FIGS. 1 and 2, a rectilinear portion of the ledge 26 will be sealed by a single fin segment while a curvilinear portion of ledge 26 is sealed by plural fin segments each subtending a relatively small central angle. Thus, as shown in FIGS. 2 and 3, the inner row of fin segments 56 uses three curvilinear segments 56*a*, 56*b*, and 56*c* to go around a 90° corner which means that each curvilinear segment subtends a central angle that is less than 30°. Similarly, the outer row of fin segments 58 uses four curvilinear segments 58*a*, 58*b*, 58*c* and 58*d* to traverse the 90° curvilinear path, each curvilinear fin segment subtending a central angle that is less than 22½°. It will be appreciated by those skilled in the art that it is desirable to minimize the gap between adjacent segments. In one constructed embodiment, the fin segments 56, 58 were molded as part of the closure 12, and the gap between adjacent curvilinear segments is 0.06 centimeters. Referring now to the fin configuration depicted in FIG. 2*a*, it can be seen that there is a large gap extending from the hinge 44 to the curvilinear segments 56*f* and 58*f* in both the inner and outer rows 56, 58 of fin segments. To obtain a more effective secondary sealing of the packaging system 10, the spacing between adjacent fin segments should be minimized as shown in FIG. 2B. What is surprising is that even with a large gap, such as that depicted in FIG. 2A, the segmented fin seal provides a significant reduction in the rate of moisture evaporation from the container body 14.

Figure 6:
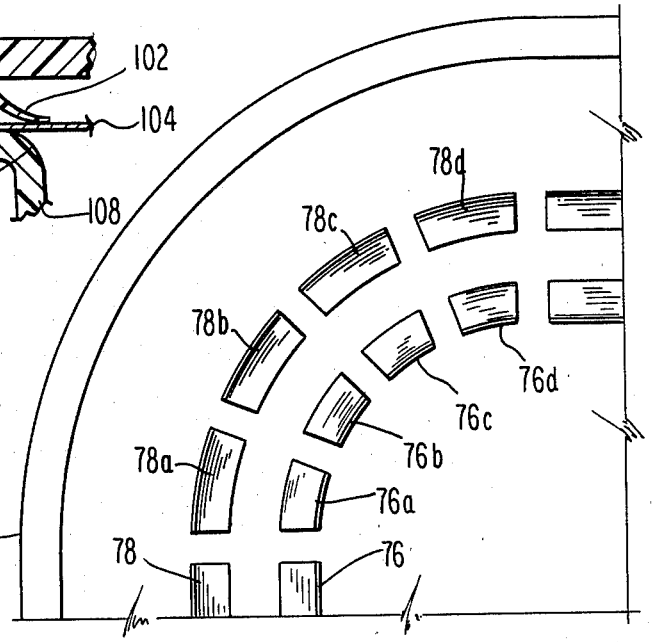
FIG. 6 is an enlarged view of a corner of a closure in which the fin segments in the two rows are not staggered.

FIG. 3 shows the preferred configuration of fin segments when plural rows 56, 58 of fin segments are employed. The segments in the two rows are positioned so that the gap between adjacent segments 56 and 56*a* in one row is directly opposite segment 58*a* in the other row, the gap between adjacent segments 56*a* and 56*b* is directly opposite fin segment 58*b*, and so forth for each gap in row 56. Similarly, the gap between adjacent segments 58 and 58*a* is directly opposite fin segment 56, the gap between adjacent segments 58*a* and 58*b* is directly opposite fin segment 56*a*, and so forth for each gap between adjacent segments in row 58. In other words, for the preferred configuration, the gap between adjacent segments of each row is always directly opposite a fin segment of the other row to provide a labyrinthian sealing effect. This is in contrast to the less preferred configuration of fin segments when plural rows 76, 78 are employed as shown in FIG. 6. In that figure, the gap between adjacent fin segments 76 and 76*a* in one row is directly opposite the gap between adjacent fin segments 78 and 78*a* in the other row, the gap between adjacent fin segments 76*a* and 76*b* is directly opposite the gap between adjacent fin segments 78*a* and 78*b*, etc. In FIG. 6, the gaps between adjacent elements in the rows are aligned to provide a non-labyrinthian seal.

Figure 4:
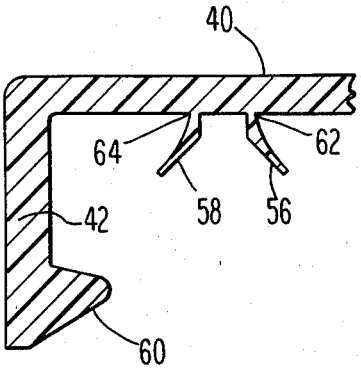
FIG. 4 is a sectional view taken along the line 4—4 of FIG. 2A.

FIG. 4, which is a sectional view taken along the line 4—4 of FIG. 2A, shows the cross-section of fin segments 56, 58. The fin segments 56, 58 extend down from the top wall 40 of closure 12 and are inclined with respect to top wall 40, that is, they extend down from the top wall 40 at other than a right angle. The design of the fin segments 56, 58 are such that a hinging action occurs at the junction 62 of fin segment 56 and top wall 40 and at the junction 64 of fin segment 58 with top wall 40.

Figure 5:
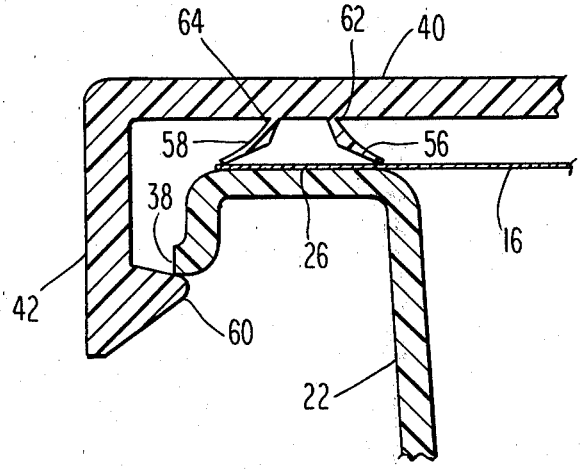
FIG. 5 is a partial sectional view illustrating the operation of two rows of segmented sealing fins when the closure is retained over the container.

FIG. 5 shows the portion of the closure 12 depicted in FIG. 4 in latching engagement with container body 14. The inward directed projection 60 of the closure 12 cooperates with the front projecting shoulder 38 of container body 14 to provide means for retaining the closure 12 over the container body 14. As shown in FIG. 5, the moisture-impervious seal 16 has not yet been broken. When the moisture-impervious seal 16 is broken and the closure 12 is latched over the container body 14, fin segments 56 and 58 are pressed into sealing engagement with the upper surface of ledge 26. The design of fin segments 56, 58 is such that substantially all of the bending of the fin segments is due to the hinging action that occurs at the junction 62 and 64 with the top wall 40 of the closure 12.

Figure 9:
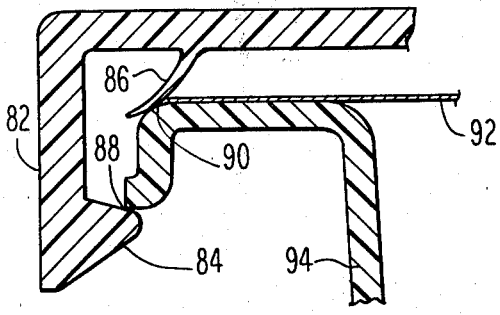
FIG. 9 is a partial sectional view illustrating the operation of a single row of fin segments sealing against an external edge of the container.
Figure 7:
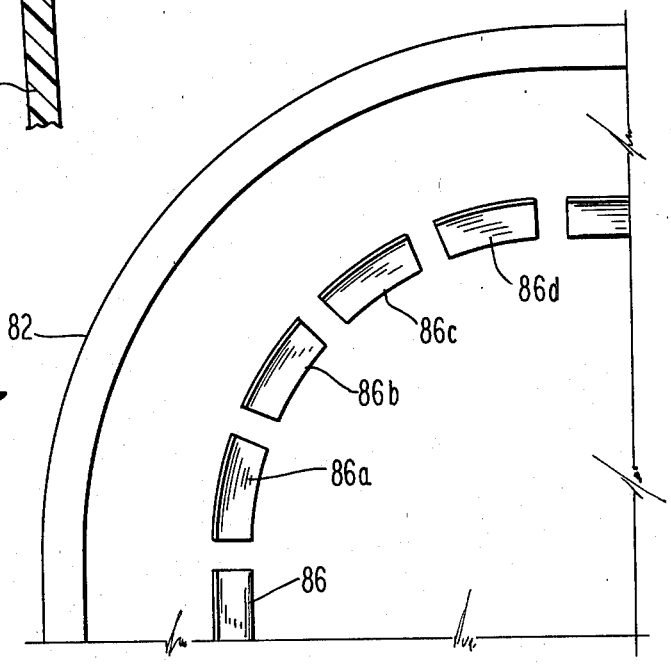
FIG. 7 is an enlarged view of a corner of a closure having a single row of fin segments.

FIGS. 7 and 9 illustrate an alternate fin configuration in which a single row of fin segments 86 is designed to contact the outer edge 90 of the ledge 26. As the closure 12 is retained over the container body 14 by the cooperative action of the inward directed projection 60 and the front extended shoulder 38, the fin segment 86 comes into sealing engagement with the outer edge 90 of the ledge 26 surrounding the opening of the container body 14. The fin segment 86 extends down at an inclined angle from the top wall 40 of the closure 12 and is designed to react to the applied sealing force primarily by bending along the entire length of the fin 86 rather than by hinging at the junction of the fin with the top wall 40 of the closure 12. The underside of the fin comes into sealing engagement with the edge 90 of the ledge 26 when the closure 12 is retained over the container body 14.

Figure 8:
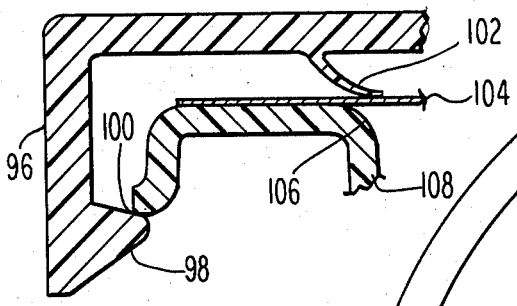
FIG. 8 is a partial sectional view illustrating the operation of a single row of fin segments which can seal against an internal edge of the container.

FIG. 8 illustrates yet another alternate embodiment employing a single row of fin segments 102. The inward directed projection 60 cooperates with the front projecting shoulder 38 to retain the closure 12 over the container body 14. When the moisture-impervious seal 16 is broken, the underside of fin segment 102 is pressed into sealing engagement with the inner edge 106 of the ledge 26 surrounding the opening of the container body 14 to provide a secondary seal for the package 10.

When testing the effectiveness of the segmented fin seals of this invention, it was surprising to learn that even with gaps between fin elements, a significant reduction in the moisture loss can be achieved. The moisture loss from a container body 14 that includes a closure 12 with a single row 86 of fin segments which seals against the external edge 90 of the flat surface 26, as depicted in FIGS. 7 and 9, was compared with the same container having a similar closure but without the fin seals of this invention. The entire length traversed by the row 86 of fin segments, including the gaps between adjacent fin segments, total approximately 45.6 centimeters. The actual fin configuration that was tested also included a substantial gap on each side of the closure 12 adjacent to the rear corners of the closure 12 as described in connection with FIG. 2A so that the cumulative length of all of the gaps totaled about 5.6 centimeters. The data obtained from one test which simulated summer conditions, shows that a package that does not employ the segmented fin seal of this invention loses about 18 percent more moisture than a package that employs a segmented fin seal. The data obtained from another test conducted at normal room temperature, but over a longer period of time, shows that a package that does not employ segmented fin seals loses about 24 percent more moisture than a package that employs a segmented fin seal. There should be a further reduction in moisture loss if the gaps at the rear of the closure were eliminated. Even a further reduction in the moisture loss should be obtained if two rows of segmented fins are employed as illustrated in FIGS. 1, 2 and 3.

Although the term package or packaging system has been used in the description, it will be apparent to those skilled in the art that the segmented sealing fins of this invention can be used with any device, such as a refillable dispenser, for storing premoistened articles. While the present invention has been described with reference to specific embodiments thereof, it will be obvious to those skilled in the art that various changes and modifications may be made without departing from the invention in its broader aspects.

What is claimed as new and desired to be secured by Letters Patent of the United States is:

1. An improved package or dispenser of the type having a container with an open end portion, a closure for covering the opening of the container and means for retaining the closure over the container body, wherein the improvement comprises flexible, segmented sealing fins extending between the closure and the container body, said fins sealing the package when the closure is retained over the container opening.

2. An improved package or dispenser as recited in claim 1 wherein the closure has a top wall and wherein the fins extend down at an angle from the top wall of the closure.

3. An improved package or dispenser as recited in claim 1 wherein two spaced-apart sets of sealing fins extend down at an angle from the top wall of the closure.

4. An improved package or dispenser as recited in claim 3 wherein the gap between adjacent segments of one set of fins is opposed to a fin segment of the other set of fins to provide additional labyrinthian sealing.

5. An improved package of the type having a container with a normally open end portion, a closure for covering the opening of the container, a moisture-impervious sheet overlying the opening of the container body to provide a primary seal for the package and means for retaining the closure over the container body, wherein the improvement comprises flexible, segmented sealing fins extending between the closure and the container body, said fins providing a secondary seal for the package when the closure is retained over the container.

6. An improved package as recited in claim 5 wherein the container body includes a surface surrounding the opening and wherein a single row of sealing fins extends at an angle from a wall of the closure and contacts the surface to seal the package after the primary seal has been broken.

7. An improved package as recited in claim 5 wherein the container body includes a ledge surrounding the opening and wherein a single row of sealing fins extends at an angle from a wall of the closure and contacts the ledge surface to seal the package after the primary seal has been broken.

8. An improved package as recited in claim 5 wherein the container body includes a ledge surrounding the opening and wherein a single row of sealing fins extends at an angle from a wall of the closure and contacts an edge of the ledge to seal the package after the primary seal has been broken.

9. An improved package as recited in claim 5 wherein the container body includes a surface surrounding the opening and wherein two spaced-apart sets of flexible segmented fins extend at an angle from a wall of the closure and contact the ledge surface to seal the package after the primary seal has been broken.

10. An improved package as recited in claim 9 wherein the gap between adjacent segments of one set of fins is opposed to a fin segment of the other set of fins to provide additional labyrinthian sealing.

* * * * *